United States Patent [19]

Erion

[11] Patent Number: 4,852,689

[45] Date of Patent: Aug. 1, 1989

[54] LADDER LEVELING ACCESSORY

[76] Inventor: George T. Erion, 1251 Upland Ave., Fort Wright, Ky. 41011

[21] Appl. No.: 120,407

[22] Filed: Nov. 13, 1987

Related U.S. Application Data

[63] Continuation-in-part of Ser. No. 896,077, Aug. 13, 1986, abandoned.

[51] Int. Cl.[4] ..... E06C 7/44

[52] U.S. Cl. ..... 182/204; 182/111

[58] Field of Search ..... 182/204, 203, 201, 214, 182/107, 111

[56] References Cited

U.S. PATENT DOCUMENTS

| | | | |
|---|---|---|---|
| 809,057 | 1/1906 | Hester | 182/204 |
| 1,246,709 | 11/1917 | Brown | 182/204 |
| 1,609,257 | 11/1926 | Lazear | 182/204 |
| 1,611,057 | 12/1926 | Neil | 182/204 |
| 3,998,293 | 12/1976 | Raia | 182/204 |
| 4,209,078 | 6/1980 | Gerber | 182/204 |

FOREIGN PATENT DOCUMENTS

| | | | |
|---|---|---|---|
| 1015336 | 9/1977 | Canada | 182/204 |

*Primary Examiner*—Reinaldo P. Machado

*Attorney, Agent, or Firm*—James W. Pearce; Roy F. Schaeperklaus

[57] ABSTRACT

A leveling device for a ladder which includes a pair of rails, hollow rungs spanning the rails, and foot members pivotally attached to lower portions of the rails. A channel shaped leveling accessory slides on a first one of the rails. Spaced openings are provided in a web of the channel shaped accessory. A selected opening can be aligned with a selected rung. An elongated pin is received in the selected opening and extends through the hollow rung. At end portions of the pin member outboard of the rails and outboard of the channel shaped accessory, fasteners are mounted in the pin member to hold the channel shaped accessory in position. An accessory foot is pivotally mounted on the accessory below the first mentioned rail. The foot members are arranged to support the ladder in upright position.

2 Claims, 2 Drawing Sheets

LADDER LEVELING ACCESSORY

BACKGROUND OF THE INVENTION

This is a continuation-in-part of my co-pending application Ser. No. 06/896,077, filed Aug. 13, 1986 now abandoned.

This invention relates to a ladder structure. More particularly, this invention relates to an accessory for a ladder to adjust the effective length of a rail of the ladder so that the ladder can rest evenly on an uneven surface and to a ladder assembly including such an accessory.

An object of this invention is to provide such a leveling accessory for a ladder having hollow rungs which comprises a generally channel-shaped body having a plurality of spaced openings in a web thereof, the body being slideable on a rail of the ladder, means on a lower end portion of the body for resting on a surface to support the body, an elongate pin member received in a selected one of the openings with the pin member being received in a selected one of the rungs of the ladder, and means for holding the pin member in position in the rung securing the body against sliding along the rail of the ladder.

An object of this invention is to provide such a ladder accessory which is provided with a swinging foot member and which can house a rail foot member when in use.

A further object of this invention is to provide such an accessory which can be mounted on a rail of a ladder having hollow rungs and in which a pin member can span and extend through openings in the rungs of the ladder and an opening in the accessory to lock the accessory in place on the ladder.

A further object of this invention is to provide such an accessory in which a plurality of openings is provided in the accessory for locking the accessory in a plurality of selected positions.

Ladders having adjustment accessories are shown in various U.S. patents such as U.S. Pat. Nos. 809,057 to Hester, 1,246,709 to Brown, 1,609,257 to Lazear and 1,611,057 to Neil, and in Canadian Pat. No. 1,015,336 to Basile. However, none of these patents shows or suggests the accessory which houses a ladder foot or the plurality of spaced openings in an accessory as set forth above.

BRIEF STATEMENT OF THE INVENTION

Briefly, this invention provides an accessory for a ladder which includes an elongated body which can be slid lengthwise of a rail of the ladder. A sufficient space is provided surrounding the rail to receive a foot member pivotally mounted on the rail. The body is provided with a plurality of openings. A pin member can extend through a selected one of the openings in the accessory and through the interior of a tubular rung of the ladder. End portions of the pin member can extend outwardly through openings in the rails of the ladder and can receive fasteners to lock the accessory in position. A pivotally mounted foot member can be mounted on the accessory to extend below the bottom of the rail for leveling the ladder on a rough or unlevel surface.

The above and other objects and features of the invention will be apparent to those skilled in the art to which this invention pertains from the following detailed description and the drawings in which:

BRIEF DESCRIPTION OF THE DRAWINGS

In the following detailed description and the drawings, like reference characters indicate like parts.

DESCRIPTION OF THE PRESENTLY PREFERRED EMBODIMENT

Figure 1:
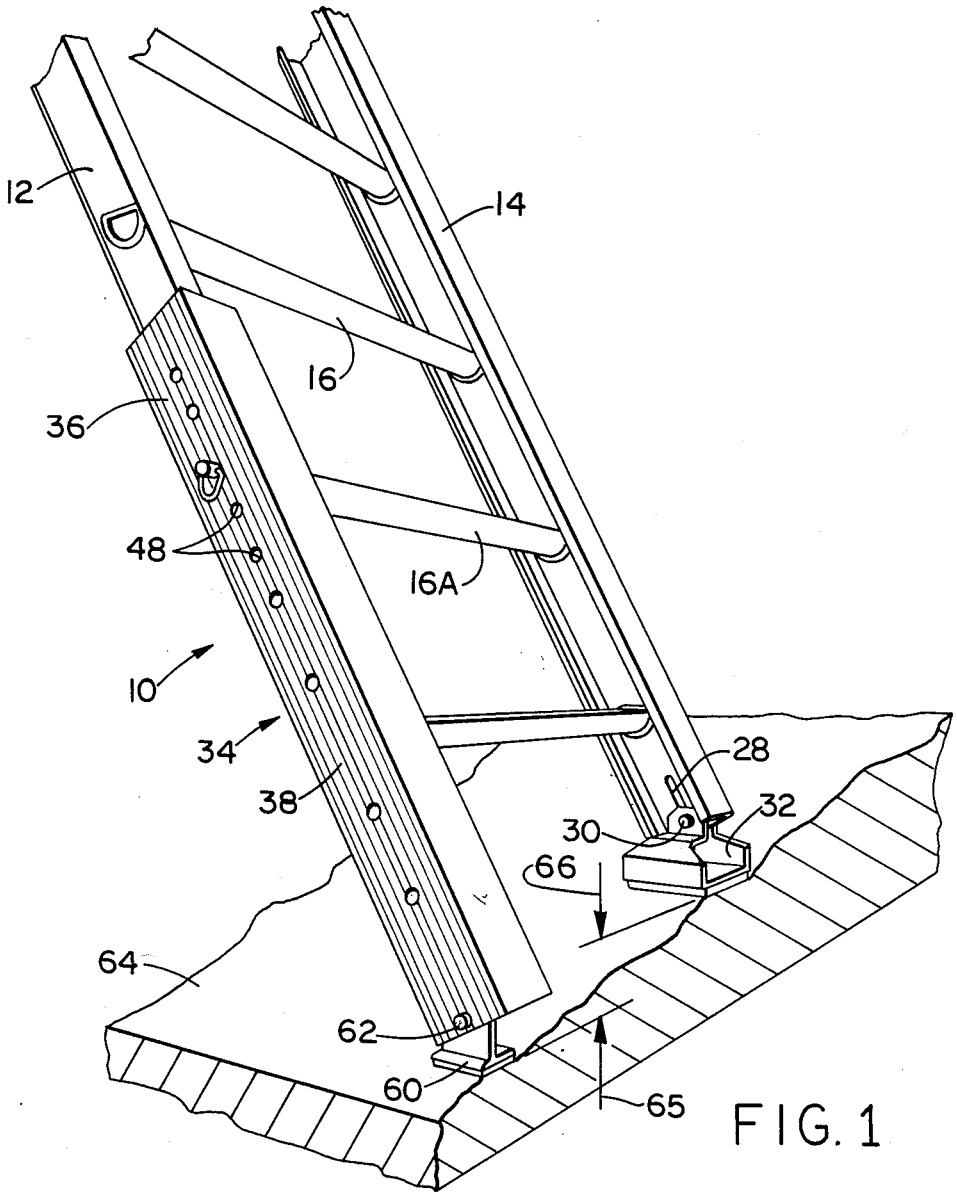
FIG. 1 is a fragmentary perspective view showing a portion of a ladder and a ladder accessory constructed in accordance with an embodiment of this invention.
Figure 2:
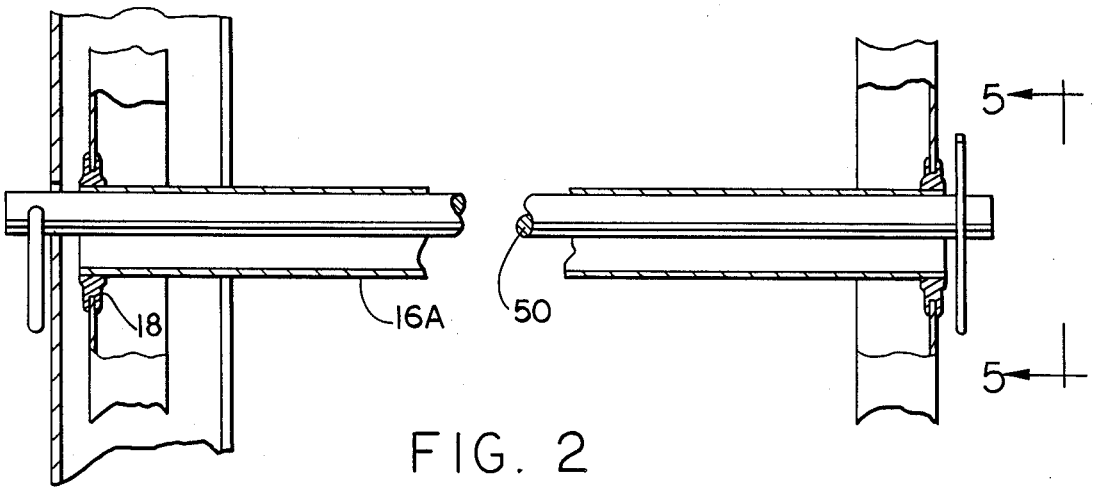
FIG. 2 is a view in upright section through a rung of the ladder showing the accessory and a pin member in position.

In FIG. 1 is shown a ladder 10 having rails 12 and 14 and rungs 16. The rungs 16 are tubular. End portions of the rungs extend through openings 18 in the rails and are attached to the rails. Near a lower end of the rail 12 is provided a slot 22 through which a pivot pin 24 extends. The pivot pin 24 supports a foot member 26. A slot 28 is formed near a lower end of the rail 14. A pivot pin 30 extends through the slot 28. The pin 30 pivotally supports a foot member 32.

A rail support assembly 34 is slidably mounted on the rail 12. The rail support assembly includes a generally channel shaped member 36 having a base web 38, main flanges 40 and 42, and auxiliary flanges 44 and 46. The free edges of the auxiliary flanges 44 and 46 are spaced so as to clear the rungs 16 as assembly 34 is slid along rail 12. A plurality of openings 48 formed in the base web 38 can receive a pin member 50. The pin member 50 can extend the length of a rung 16A with end portions of the pin member exposed outboard of the base web 38 and the rail 14. An opening 52 in the pin member 50 outboard of the base web receives a split ring member 54. An opening 56 in the pin member 50 outboard of the rail 14 receives a latch pin 58. The split ring member 54 and the latch pin 58 lock the pin member 50 in position. An accessory foot member 60 is pivotally mounted on the base web 38 of the channel shaped member by means of a fastener 62.

Figure 3:
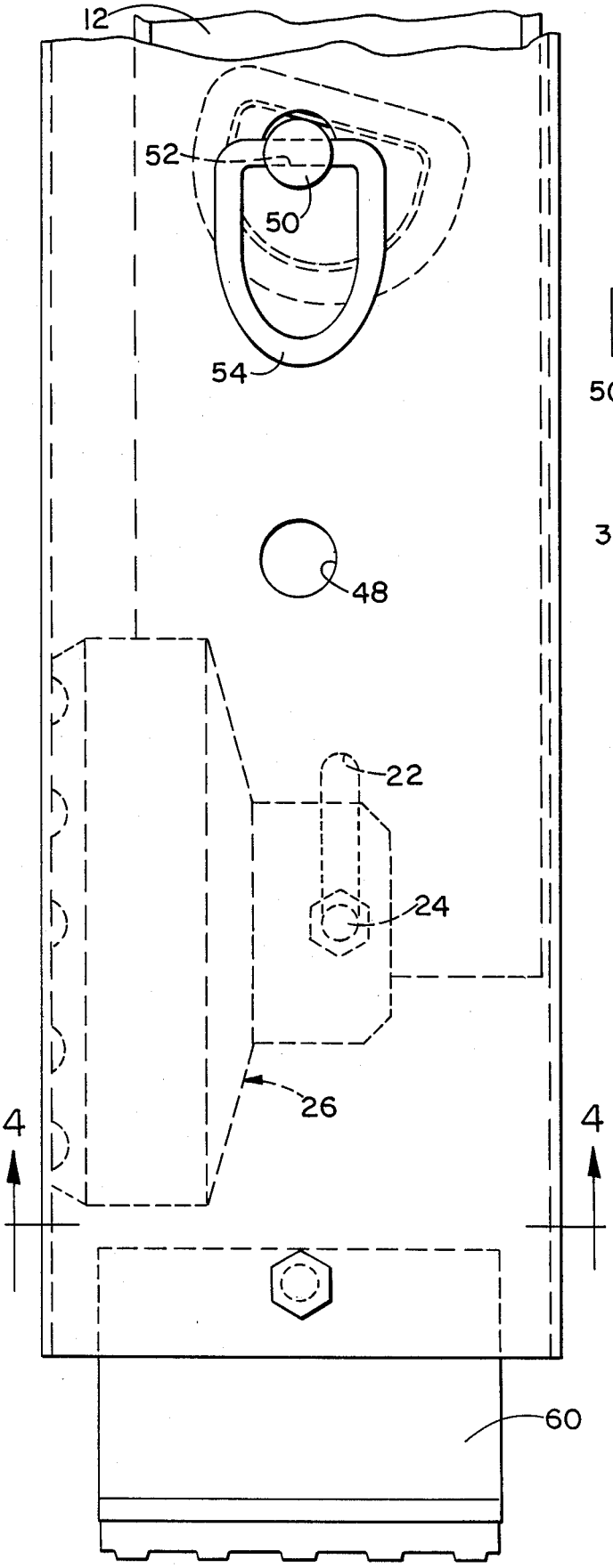
FIG. 3 is a fragmentary view in side elevation of the ladder and the accessory.
Figure 4:
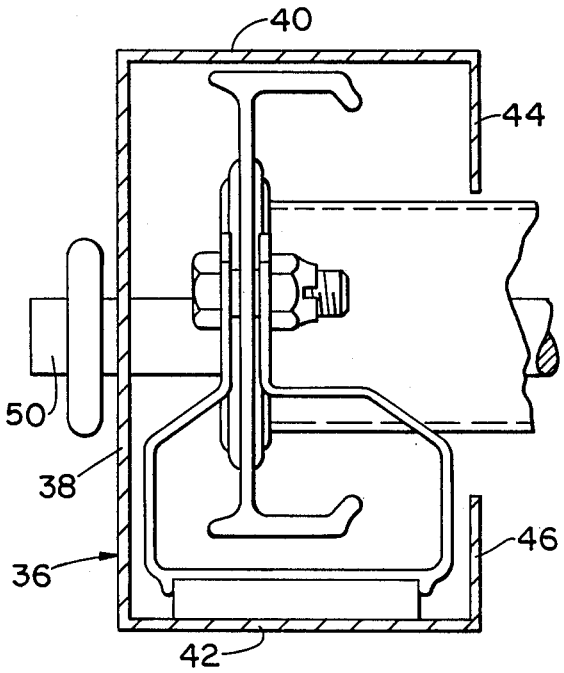
FIG. 4 is a view in section taken on the line 4—4 in FIG. 3.
Figure 5:
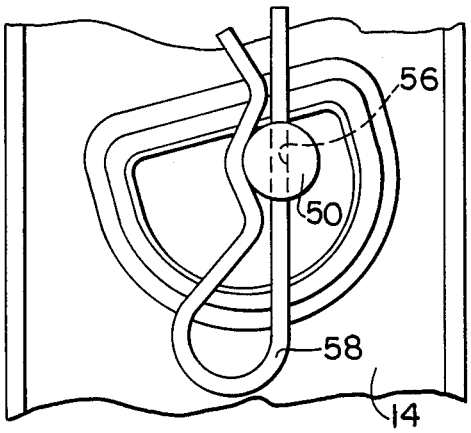
FIG. 5 is a view in side elevation of the ladder looking in the direction of the arrows 5—5 in FIG. 2.

As shown in FIG. 3, the foot member 26 can be housed inside the rail support assembly when not in use.

The position of the channel shaped member 36 on the rail 12 can be adjusted by removal of the pin member 50 and movement of the channel shaped member along the rail 12 until a selected one of the openings 48 is aligned with a selected one of the rungs 16. Then, the pin member 50 can be placed in the selected opening and rung. The position of the channel shaped member 36 is adjusted so that the ladder can be properly supported on an uneven surface 64 when ladder foot member 32 rests on surface 64 at elevation 66 and accessory foot member 60 on surface 64 at elevation 65.

The ladder leveling accessory illustrated in the drawings and described above is subject to structural modification without departing from the spirit and scope of the appended claims.

Having described my invention, what I claim as new and desire to secure by letters patent is:

1. The combination of a ladder which includes a pair of rails, at least one hollow rung spanning the rails, and a respective foot member pivotally attached to a lower portion of each of the rails with a generally channel shaped leveling accessory slideably mounted on one of the rails, the foot member pivotally attached to the rail upon which the accessory may be slideably mounted being swingable between a ladder supporting position transversely of the said rail and a storage position extending lengthwise of the said rail, the channel shaped accessory being slideable on the rail and receiving the foot member thereof when the foot member pivotally attached to the rail is in storage position, there being a plurality of spaced openings in a web of the channel shaped accessory alignable with the rung, an elongated pin received in a selected one of the openings and extending through the hollow rung, means at end portions of the pin member outboard of the channel shaped accessory and outboard of the other rail for preventing withdrawal of the pin member through the rung and the selected opening in the. accessory, whereby the pin member holds the channel shaped accessory in position and an accessory foot pivotally mounted on the accessory below the said one of the rails, the foot member of the one rail and of the accessory mounted on the other rail being arranged to support the ladder in upright position.

2. The combination of a ladder which includes a pair of rails, a plurality of hollow rungs spanning the rails, and a respective foot member pivotally attached to a lower portion of each of the rails with a generally channel shaped leveling accessory slideably mounted on a first one of the rails, the foot member pivotally attached to the first one of the rails being swingeable between a ladder supporting position transversely of the said rail and a storage position extending lengthwise of the said rail, the channel shaped accessory being slideable on the rail and receiving the foot member thereof when the foot member povitally attached to the rail is in storage position and the accessory spans said foot member, there being a plurality of spaced openings in a web of the channel shaped accessory alignable with the hollows of the rungs, an elongated pin received in a selected one of the openings and extending through the associated hollow rung, means at end portions of the pin member outboard of the channel shaped accessory and outboard of a second one of the rails for preventing advancement of the pin member out of at least one of the rungs and the selected opening in the accessory to lock the accessory in place on the ladder, an accessory foot pivotally mounted on the accessory, whereby the pin member holds the channel shaped accessory in position with the accessory foot pivotally mounted on the accessory below the first mentioned rail, the foot member of the accessory and the foot member of the other rail being arranged to support the ladder in upright position on an uneven surface.

* * * * *